United States Patent [19]

Stark et al.

[11] 4,031,806

[45] June 28, 1977

[54] INTERNAL UMBILICAL CONNECTOR FOR MISSILES

[75] Inventors: Sidney Stark; Fred T. Sumner, both of Orlando, Fla.

[73] Assignee: The United States of America as represented by the Secretary of the Army, Washington, D.C.

[22] Filed: Sept. 1, 1976

[21] Appl. No.: 719,499

[52] U.S. Cl. ..... 89/1.811; 102/105; 244/3.1

[51] Int. Cl.[2] ..... F41F 3/04

[58] Field of Search ..... 89/1.811; 102/105, 49.4, 102/49.3; 244/3.26, 3.1, 158; 188/289

[56] References Cited

UNITED STATES PATENTS

| | | | |
|---|---|---|---|
| 2,814,250 | 11/1957 | Everett | 102/49.4 |
| 2,936,710 | 5/1960 | Bollay | 244/3.26 X |
| 3,152,667 | 10/1964 | Powell | 188/289 |
| 3,262,655 | 7/1966 | Gillespie | 244/3.1 |
| 3,444,779 | 5/1969 | Buell et al. | 89/1.811 |
| 3,490,373 | 1/1970 | Fox | 102/49.3 UX |

*Primary Examiner*—David H. Brown
*Attorney, Agent, or Firm*—William G. Gapcynski; Lawrence A. Neureither; Harold W. Hilton

[57] ABSTRACT

An assembly which is an energy absorbing system for supporting the nose cone of a missile in a position extended from the guidance section prior to eject (launch) of the missile. This extended position exposes internal umbilical connectors to permit internal missile components to be connected to external sources of power (electrical, pneumatic, etc.). Gravitational forces during eject (launch) displace the nose cone rearwardly against the guidance section. The assembly controls impact velocity of the nose cone and guidance section during closure thereof. At closure, a smooth aerodynamic surface is formed at the junction of the nose cone and guidance section.

5 Claims, 5 Drawing Figures

INTERNAL UMBILICAL CONNECTOR FOR MISSILES

BACKGROUND OF THE INVENTION

Missiles having internal components which require connection to a source of power (electrical, pneumatic, etc.) prior to launch are typically provided with openings in the shell of the missile in which is mounted a missile umbilical connector which is provided with terminals or conduits which connect to various internal components. An external connector connected to a source of power is mated to the missile umbilical connector prior to launch. Doors are usually provided to close over the missile umbilical connector access in an effort to provide a substantially smooth aerodynamic surface over the missile umbilical connector access during flight of the missile.

SUMMARY OF THE INVENTION

An assembly in a missile for retention of the nose cone and guidance section in spaced relation prior to launch to expose internal missile umbilical connectors for mating relation with external umbilical connectors. The assembly includes a first tubular member having one end secured to the nose section and a second end extending rearwardly in telescoped relation with a first end of a second tubular member. The second end of the second tubular member is secured to the guidance and control section. A piston is slidably carried in the first end of the second tubular member. The piston includes an orifice having a burst plug therein. A metering pin is secured in the second tubular member in abutting relation with the burst plug in the piston. Responsive to the missile attaining a predetermined velocity, the nose section is displaced rearwardly whereby the metering pin forces the burst plug out of the piston orifice. Hydraulic fluid flow is metered through flutes on the metering pin, in its movement through the piston orifice, into the first tubular section to control the rate of displacement of the nose section and, thus, the impact velocity of the nose and guidance section during closure thereof.

DESCRIPTION OF THE PREFERRED EMBODIMENT

Figure 1:
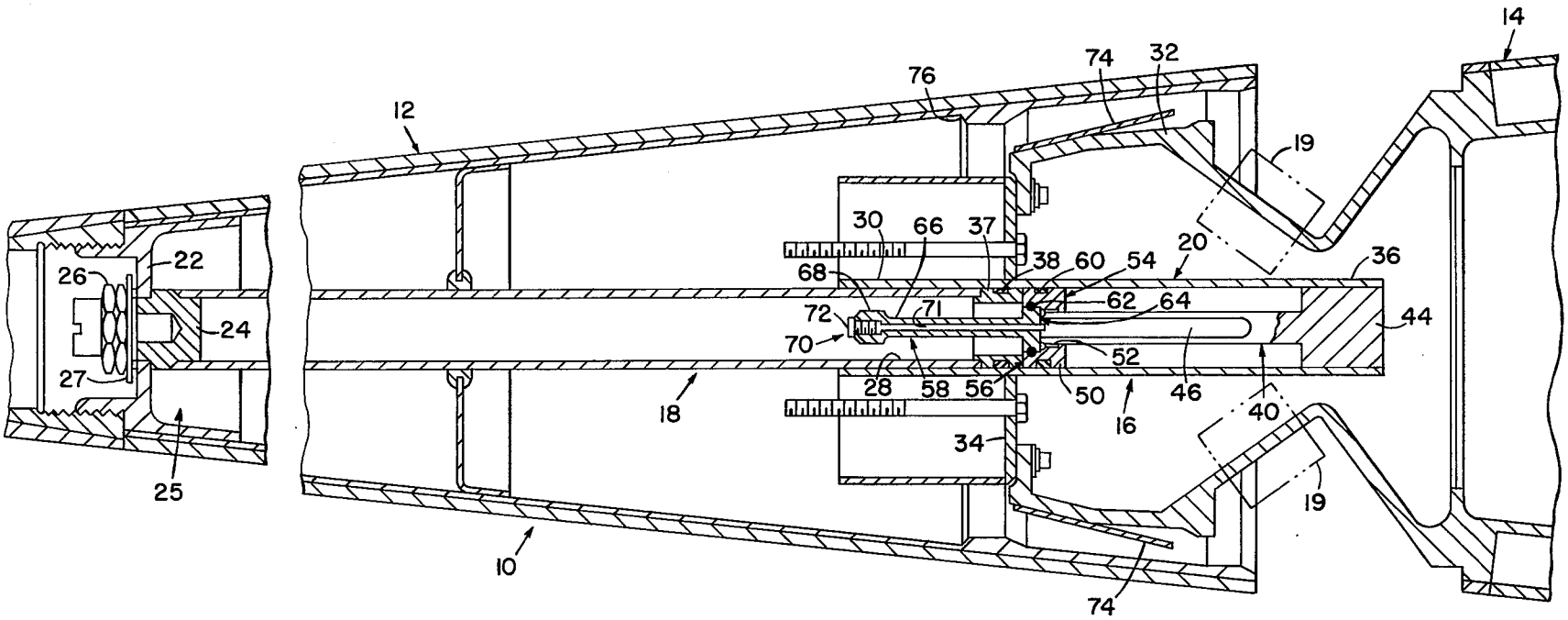
FIG. 1 is an elevational sectional view illustrating the nose hydraulic assembly retaining the missile nose section and guidance and control section in spaced relation.

As shown in FIG. 1 a missile 10 is provided with a nose cone section 12 and a guidance and control section 14 secured in spaced relation by a nose hydraulic assembly 16 to expose internal missile umbilical connectors 19 which are connected to internal missile components by conduits, cables, etc. (not shown).

Nose hydraulic assembly 16 is provided for retention of the nose and guidance sections in spaced relation prior to launch and to limit the rate of rearward displacement of the nose section responsive to acceleration forces acting thereon whereby impact velocity of the sections are controlled during closure thereof. To this end, hydraulic assembly 16 includes an upper slide tube 18 secured to nose 12 of the missile and a lower slide tube or reservoir 20 secured to the guidance and control section 14 of the missile.

To secure slide tube 18 to nose 12 an inwardly extending annular flange 22 is provided in the missile nose section through which an end plug 24, secured in the first end 25, of upper slide tube 18 extends. A screw 26 extends through a washer 27, having a larger diameter than the flange opening, for threaded relation with end plug 24 of slide tube 18. The second end 28 of the upper slide tube extends inside the first end 30 of lower slide tube 20 which is secured to a frame portion 32 of guidance and control section 14 by a bracket assembly 34. A second end 36 of slide tube 20 extends rearwardly into frame portion 32 of guidance and control section 14.

To permit ease of sliding movement of upper slide tube 18 and to prevent leakage of hydraulic fluid between the upper and lower slide tubes, slide tube 18 is provided at the second end 28 thereof with an annular member 37 secured to tube 18 and provided with an O-ring gland 38 to seal against leakage of hydraulic fluid.

Figure 3:
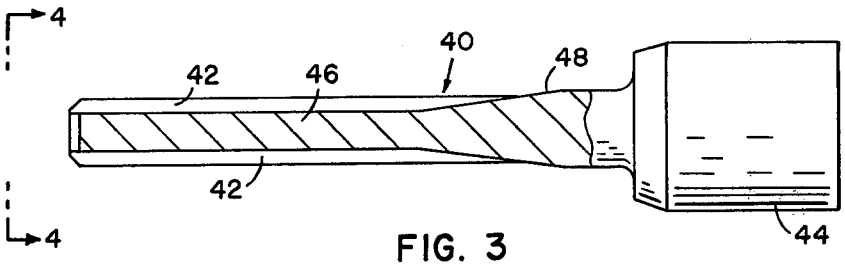
FIG. 3 is an elevational view, partially in section, of the metering pin utilized in the hydraulic assembly of FIG. 1.
Figure 4:
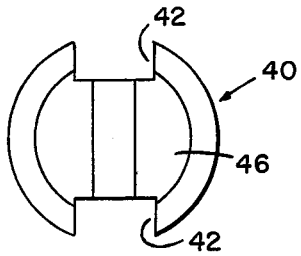
FIG. 4 is an end view of the metering pin taken along line 4—4 FIG. 3.

End 36 of the lower slide tube 20 encloses a double fluted metering pin 40 (FIGS. 1 and 3) of circular cross-section with rectangular shaped flutes 42. The metering pin is provided with an end portion 44 which is welded to lower slide tube 20 and a second portion 46 of smaller diameter. The metering pin is tapered so that the orifice area is constant for substantially the first 2 inches of travel, then reducing to a minimum at a predetermined position 48 (FIG. 3) on the pin for reasons explained below.

Figure 2:
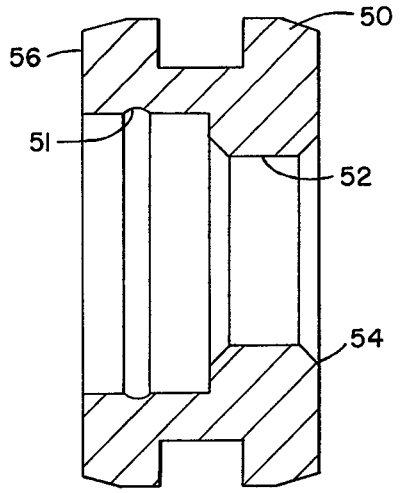
FIG. 2 is an elevational sectional view of the piston of the hydraulic assembly of FIG. 1.

A piston 50 (FIGS. 1 and 2) is carried in lower slide tube 20 for abutting relation with annular member 37 of upper slide tube 18. The piston is a short circular cylinder with an orifice opening 52 at an end 54 through which the metering pin and hydraulic fluid pass during system operation. The opposite end 56 of piston 50 is counter-bored and undercut with a groove 51 for positioning and retaining a pushout plug 58 (FIG. 1). An O-ring 60 is disposed around piston 50 (FIG. 1).

Figure 5:
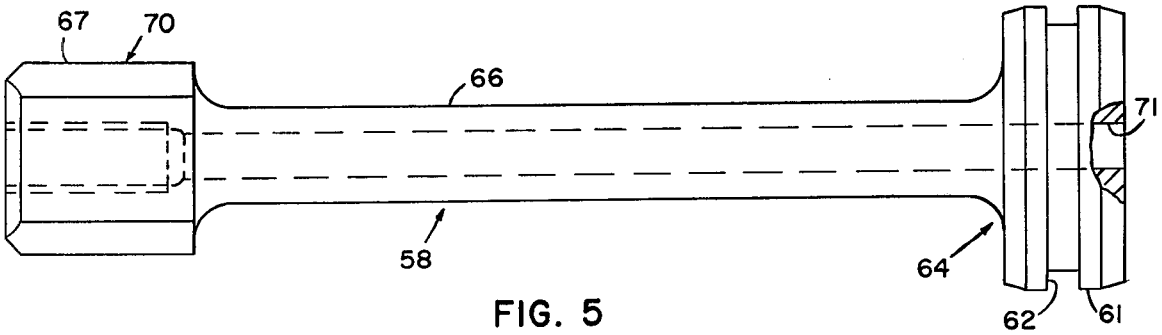
FIG. 5 is an elevational view, partially in section, of the burst plug used in the hydraulic assembly of FIG. 1.

The pushout plug 58 (FIGS. 1 and 5) is a dog bone shaped part with a circular plug 61 and an O-ring gland 62 at one end 64 thereof extending with a hollow stem 66 supporting a tapped rectangular boss 67 on the opposite end 70. A bleed-off hole 71 extends through the pushout plug.

Pushout plug 58 is positioned and retained in the piston (FIG. 1) by positioning O-ring 62 in the gland of plug 58 and in groove 51 (FIG. 2) in the undercut portion of piston 50. This retards any motion prior to eject and provides a seal for the orifice opening 52. The hollow stem permits the reservoir to be top filled and excess hydraulic fluid bled off during installation of the piston and pushout plug assembly.

The piston with pushout plug installed is inserted into the charged reservoir until the pushout plug is in contact with the metering pin. Bleed-off hole 71 is capped off by sealwasher and screw assembly 72 (FIG. 1).

Upper slide tube 18 assembled to the nose cone is inserted into the lower slide tube (reservoir) 20 until contact is made with piston 50, this establishes the extended position of nose cone 12. Stem portion 66 of the pushout plug will extend into upper slide tube 18.

Under predetermined acceleration forces piston 50 is displaced rearwardly against the distal end of metering pin 40. Pushout plug 58 is ejected from piston 50 into upper slide tube 18, allowing nose cone 12 and upper slide tube 18 to force piston 50 aft, thus metering fluid flow through the orifice 52 and flutes 42 of the metering pin. Fluid flow is constant as piston 50 moves over the constant area flutes 42. As piston 50 is displaced past the tapered portion, fluid flow decreases until the piston is seated against surface 48 (FIG. 3) of the metering pin, at which point closure is accomplished. A plurality of nose locking fingers 74 is secured to frame portion 32 for engagement with an annular shoulder 76 of nose section 12 to retain the nose section 12 and guidance and control section 14 in secured relation.

We claim:

1. A missile having a movable nose cone, a body section, and internal umbilical connectors carried in said body section, means for retention of said nose cone and said body section in spaced relation to give access to said internal umbilical connectors and for controlling the impact velocity of said nose cone and body section during closure thereof responsive to predetermined acceleration forces acting on said nose cone.

2. A missile as in claim 1 wherein said means for retention of said nose cone and said body section in spaced relation includes:

a. a first tubular member secured to said nose cone, said first tubular member disposed for displacement responsive to said predetermined acceleration forces acting on said nose cone;

b. a second tubular member secured to said body section, said tubular members disposed in telescoping relation;

c. a piston carried in said second tubular member, said piston having a central orifice therein, said piston disposed for displacement by said tubular member responsive to movement thereof;

d. knock-out plug means carried in said piston orifice;

e. metering pin means carried in said second tubular member for ejecting said knock-out plug means responsive to displacement of said first of said pair of members, said metering pin means further disposed for metering fluid flow through said piston orifice to limit the rate of displacement of said first member.

3. Apparatus as set forth in claim 2 wherein said metering pin means includes a first cylindrical section secured to said second tubular member and a second smaller diameter section having rectangular flutes thereon, the distal end of said second section disposed in abutting relation with said knock-out plug means prior to displacement of said nose cone.

4. Apparatus as set forth in claim 3 wherein said piston is a short circular cylinder having an undercut portion communicating with said central orifice, said undercut portion having an annular groove therein.

5. Apparatus as set forth in claim 4 wherein said knock-out plug means is provided with a bone-shaped configuration having a circular plug and O-ring gland at one end, a hollow stem portion extending from said circular plug having a tapped rectangular boss at its distal end, and plug means disposed for secured relation in said boss, an O-ring installed in said O-ring gland and positioned in said groove in said undercut portion of said piston for retention of said knock-out plug means in said piston.

* * * * *